United States Patent [19]

Clark, Jr.

[11] Patent Number: 5,052,268

[45] Date of Patent: Oct. 1, 1991

[54] PRESELECTOR

[76] Inventor: Melville Clark, Jr., 8 Richard Rd., Wayland, Mass. 01778-4099

[21] Appl. No.: 549,544

[22] Filed: Jul. 9, 1990

Related U.S. Application Data

[63] Continuation of Ser. No. 214,007, Jun. 30, 1988, abandoned, which is a continuation-in-part of Ser. No. 457,436, Jan. 12, 1983, abandoned.

[51] Int. Cl.[5] ..... G10H 7/00

[52] U.S. Cl. ..... 84/615; 84/602; 84/622; 84/626; 84/345

[56] References Cited

U.S. PATENT DOCUMENTS

| | | | |
|---|---|---|---|
| 3,700,784 | 10/1972 | Molnar | 84/345 |
| 3,733,593 | 5/1973 | Molnar | 84/345 X |
| 4,185,531 | 1/1980 | Oberhein et al. | 84/1.24 |
| 4,244,263 | 1/1981 | Deutsch et al. | 84/345 |
| 4,296,667 | 10/1981 | Wade et al. | 84/345 |

*Primary Examiner*—A. T. Grimley
*Assistant Examiner*—Matthew S. Smith
*Attorney, Agent, or Firm*—Fish & Richardson

[57] ABSTRACT

A preselector for a musical instrument includes a memory that stores data for controlling sound parameters emitted by the musical instrument when read from memory in response to actuation of a finger or pedal bar switch. For each independent parameter to be controlled, there is a set of lighted momentary push-button switches that determines the magnitude of that parameter. These values are written into the memory during a first mode at an address determined by the number of depressions of any actuating bar, such as a finger bar or toe bar. The lights behind the switches indicate the magnitude of the parameter. Alternatively, a variable potential converted to a digital signal by an analog-to-digital converter can be used to define the magnitude of the parameter. Just before performance after the values of all the parameters have been written into the memory in the sequence in which they are to be used, an address counter is reset to its initial value. Depression of any bar causes the counter to be advanced once, thereby reading out from memory the new values of the parameter set to be controlling. These values are coupled to a set of RS flip-flops whose outputs are decoded by AND to provide a signal for illuminating a light to indicate the magnitude of the parameter. The outputs of the flip-flops also provide a digital representation of the value of the parameter to the musical instrument sound generators.

26 Claims, 7 Drawing Sheets

PRESELECTOR

FIG.1 PRESELECTOR

FIG. 2 MEMORY INPUT CIRCUITRY

FIG.5 COUPLING NETWORK

FIG.6 COUPLING NETWORK

HYSTERESIS-BASED OUTPUT CIRCUIT

HYSTERESIS-BASED OUTPUT CIRCUIT

PRESELECTOR

This application is a continuation of application Ser. No. 07/214,007 filed June 30, 1988now abandoned 7/9/90, which is a continuation-in-part of copending application Ser. No. 06/457,436, filed Jan. 12, 1983 now abandoned 5/12/89, entitled A NEW PRESELECTOR, by Melville Clark, Jr., hereby incorporated by reference.

BACKGROUND OF THE INVENTION

In musical instruments having substantial tonal resources, it is frequently necessary to effect elaborate changes in the values of various controls used to define the tonal resources in times of the order of 0.2 second with as little effort on the player's part as possible, even though dozens of parameters must be redefined. As pointed out by Melville Clark in a PROPOSED KEYBOARD MUSICAL INSTRUMENT, J. Acoust. Soc. Am., 31, 403–419 (1959), FIGS. 17 and 18 particularly or U.S. Pat. No. 3,120,636, these changes can be effected with a finger bar that runs parallel to and that is placed between the manuals of a multimanual instrument and by another toe bar that runs parallel to the pedal clavier and just above the front thereof. Depression of any one of the bars causes the next preselected combination to appear essentially instantly. To this end, only a single finger or the toe of either foot need be used; this actuation can be accomplished without removing either hand from its respective keyboard or either foot from the pedalboard. It was further pointed out in the references cited that with differential control, the values of any of the parameters could be readjusted by the player anytime after the depression of any bar without disturbing the system.

Before a composition is played the values of many parameters can and should be settled upon. The tone colors to be used for each musical element at each stage of the composition, the degree of choral massiveness, and the apparent location and size of the sound source are among these parameters that should and can be preselected before a composition is played. These values are stored in a memory and brought into action in sequence upon depressing any of the bars.

SUMMARY OF THE INVENTION

There are three modes of operation of the system: (1) a mode in which the values of each parameter are read into a memory in sequence, (2) a mode in which the values of each parameter are read out of the memory in sequence, and (3) a mode in which the value of each parameter established by the memory may be overridden and readjusted by the player. The first mode is used during the period of preselection, and the second and third modes are used during the performance of the composition.

For each independent parameter to be controlled, there is a set of lighted momentary pushbutton switches that determines the magnitude of that parameter. These values are read into the memory during the first mode at an address determined by the number of depressions of any actuating bar, such as a finger bar or toe bar. The lights behind the switches indicate the magnitude of the parameter. Alternatively, a variable potential converted to a digital signal by an analog-to-digital converter can be used to define the magnitude of the parameter.

Just before performance after the values of all parameters have been read into the memory in the sequence in which they are to be used, the address counter is reset to its initial value. Depression of any bar causes the counter to be advanced once and the new values of the parameter set to be brought into play. These are coupled to a set of RS flip flops that remember the digital values of these parameters. The outputs of these flip flops are decoded by AND gates to determine which light corresponding to the parameter involved is to be turned ON to indicate the magnitude of that parameter. Further, the outputs of the flip flops provide a digital representation of the value of the parameter to the sound generators. Because of the character of the coupling to the RS flip flops, they may be overridden and reset any time after the memory has once determined their values, simply by depressing the relevant switch or turning the relevant potentiometer. In fact, because the memory is of a kind that acts in less than a microsecond, the overriding will appear to the player to be instantaneous, if the player so desires. It is believed that a relatively simple system has been evolved to achieve the objective cited.

DETAILED DESCRIPTION

Figure 1:
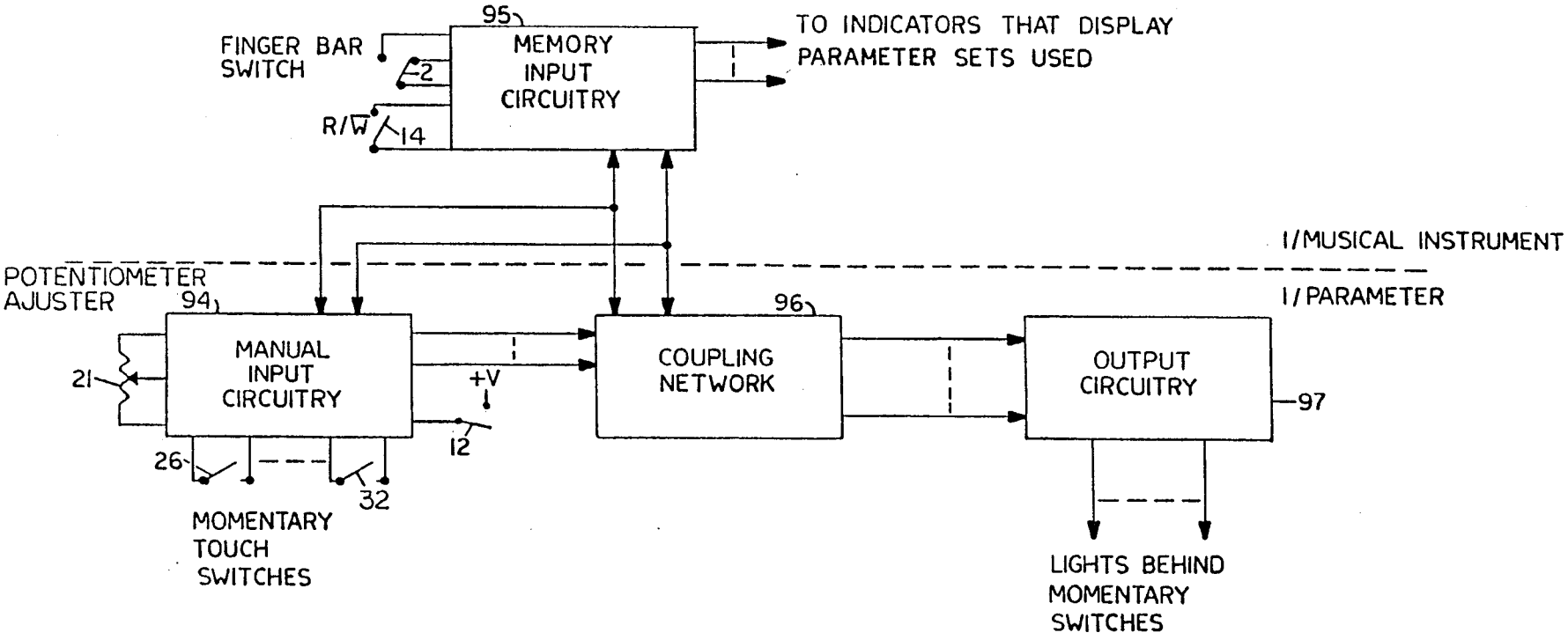
FIG. 1 is a block diagram of the system.

FIG. 1 generally shows the relations of the various subsystems to each other. The memory-input circuitry 95 includes the memory-address-determining means. The memory-input circuitry provides its stored data to a coupling network 96. The manual input circuitry 94 may also provide instantaneous data to the coupling network 96. The coupling network 96 provides its data to the output circuitry 97 that indicates the intensity of the parameter to be controlled and provides a static output to the sound generators the parameters of which are to be controlled by the present hardware.

Figure 2:
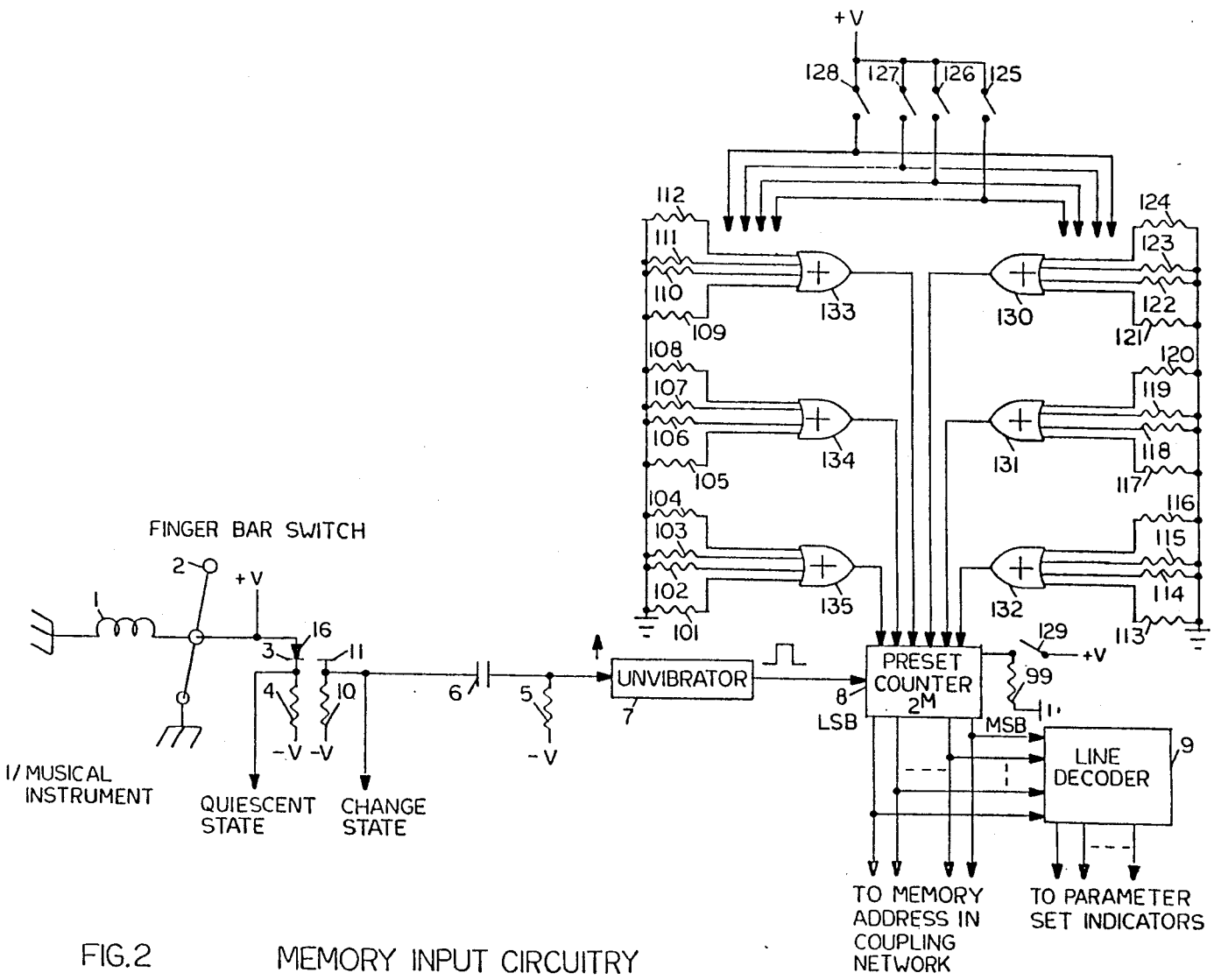
FIG. 2 is a schematic and block diagram of the memory input circuitry.

FIG. 2 displays the details of the memory-input circuitry. The finger bar 2 shown is restrained by tension spring 1 in its forward motion. In its undepressed position the finger bar 2 closes a switch contact 3 to a source of affirmation potential. This contact 3 is also connected through a resistor 4 to a source of negation potential.

Actuation of the finger bar 2 (or toe bar in parallel with this finger bar) against the tension spring 1 causes the switch contact 11 to be connected to an affirmation potential. This contact is also connected to a negation potential through a resistor 10 and to a capacitor 6 the other side of which is connected through a resistor 5 to a negation potential and to the positive-going trigger input of a univibrator 7, which triggers when switch 16 touches contact 11 because the potential across the capacitor 6 cannot change instantaneously. This input to the univibrator 7 gradually returns to the negation potential because of the resistor 5 connected between those two points. The output of this univibrator 7 is connected to a presettable counter 8 and provides an advance signal that causes it to increment by one count each time the univibrator is triggered, i.e., each time the finger bar 2 is actuated. The output of this binary counter 8 is decoded by line decoder 9, which excites one and only one lamp to indicate the address generated by the counter 8. The output of the counter 8 is also applied as the address input of main memory 33, each complete word of which stores one complete specification in binary of the values of all parameters. The preset inputs of the counter 8 are excited by the outputs of a decoder comprised of the OR gates 130 through 135 and the grounded resistors 101 through 124. One side of the momentary switches 125 through 128 is connected to an affirmation potential. The other side of each switch is connected matrix fashion to no line or one line into each of the OR gates 130 through 135. The connections of each switch provide a binary encoding of the address of a preselected combination to which the player would like to transfer at some point in the playing of the composition. Whenever any one of these switches 125 through 128 is depressed, the decoder creates a binary output that presets the counter to a specific individual address when the preset-mode switch 129 is also depressed. Thus, these switches may be used to jump to some arbitrary, predetermined address of the memory, thus enabling Dal Segno's and Da Capo's, which occur frequently in music, or the skipping over some intermediate measures of music to some more remote measure, as occurs often in rehearsals (and sometimes during performance too). Depression of the finger bar 2 (or toe bar) causes the quiescent output line of the switch 16 to change from an affirmation potential to a negation potential and the change-of-state line of the switch 16 to change from a negation potential to an affirmation potential. The line decoder 9 causes indicators, not shown, to illuminate to indicate the address in memory being interrogated, and, thus, the set of values of parameters being used.

Figure 3:
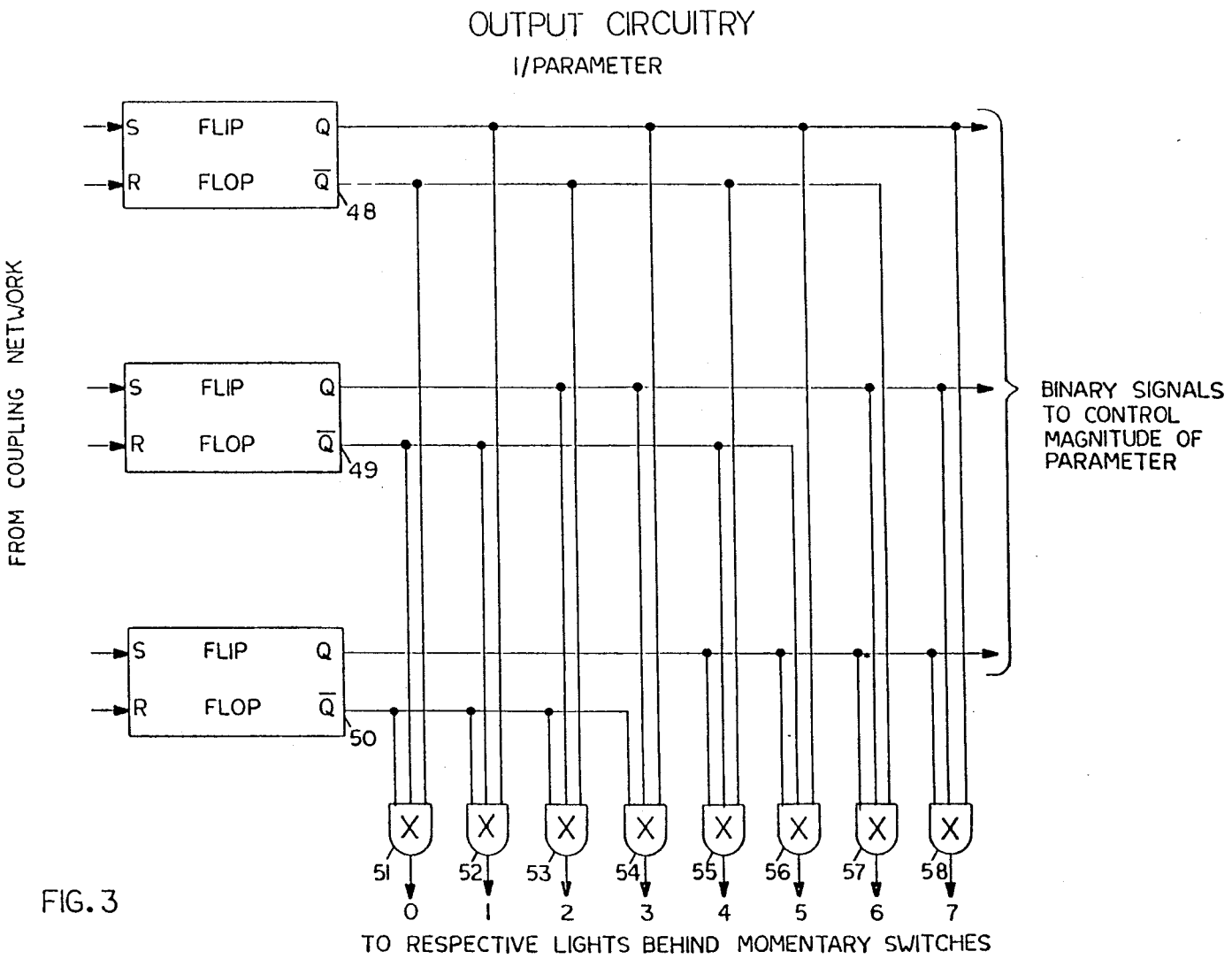
FIG. 3 is a schematic and block diagram of the output circuitry of the system.

FIG. 3 displays the output circuitry. The coupling network determines the state of each RS flip flop 48, 49, and 50. These flip flops 48, 49, and 50 store the magnitude in binary of each parameter to control the respective sound generators, until the parameter value is again changed. The outputs of the RS flip flops 48, 49, and 50 form a binary designation of the amplitude of the parameter with which each such set of flip flops is associated. The outputs of these flip flops 48, 49, and 50 are decoded by AND gates 51 through 58 and used to indicate the intensity with which the associated parameter is to be implemented. The outputs of these AND gates are connected to respective lights (also not shown) one and only one of which illuminates each of the parameter-magnitude-determining momentary switches 26 through 32, shown in FIG. 4. Thus, one and only one of these switches will be illuminated at any one time.

Figure 4:
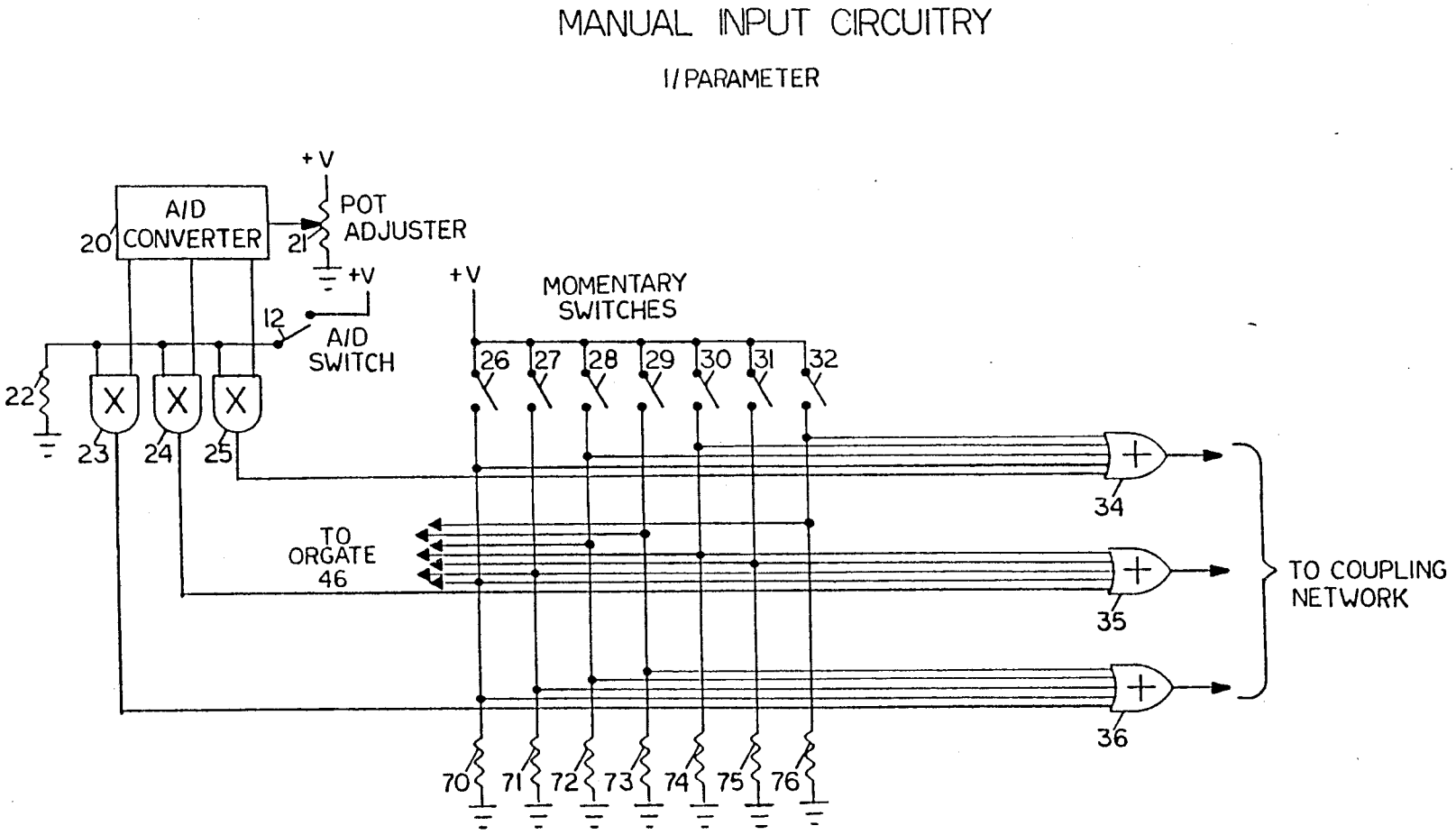
FIG. 4 is a schematic and block diagram of the manual input circuitry for the system.

FIG. 4 displays the manual input circuitry that may be used to modify the changes caused by the memory. One side of switches 26 through 32 is connected to an affirmation potential; the other side of these switches is connected to a respective one of the resistors 70 through 76, the other end of which is connected to ground. The ungrounded ends of these resistors are also connected to the inputs of various ones of the OR gates 34, 35, and 36. These connections are such that each switch-resistor combination defines a unique magnitude in binary code.

Analog control can also be achieved by a potentiometer 21 connected to a potential source, said potentiometer wiper being connected to an analog-to-digital converter 20 the binary output of which excites AND gates 23, 24, and 25. The other inputs of each of these AND gates is excited by the output of a switch 12 connected to ground through a resistor 22 and that may be switched to an affirmation potential. When switch 12 is so connected to an affirmation potential, the AND gates 23, 24, and 25 convey the binary output of the analog-to-digital converter 20 to respective OR gates 36, 35, and 34. Thus is the analog potential defined by the potentiometer 21 converted to digital and conveyed to the coupling network.

Figure 5:
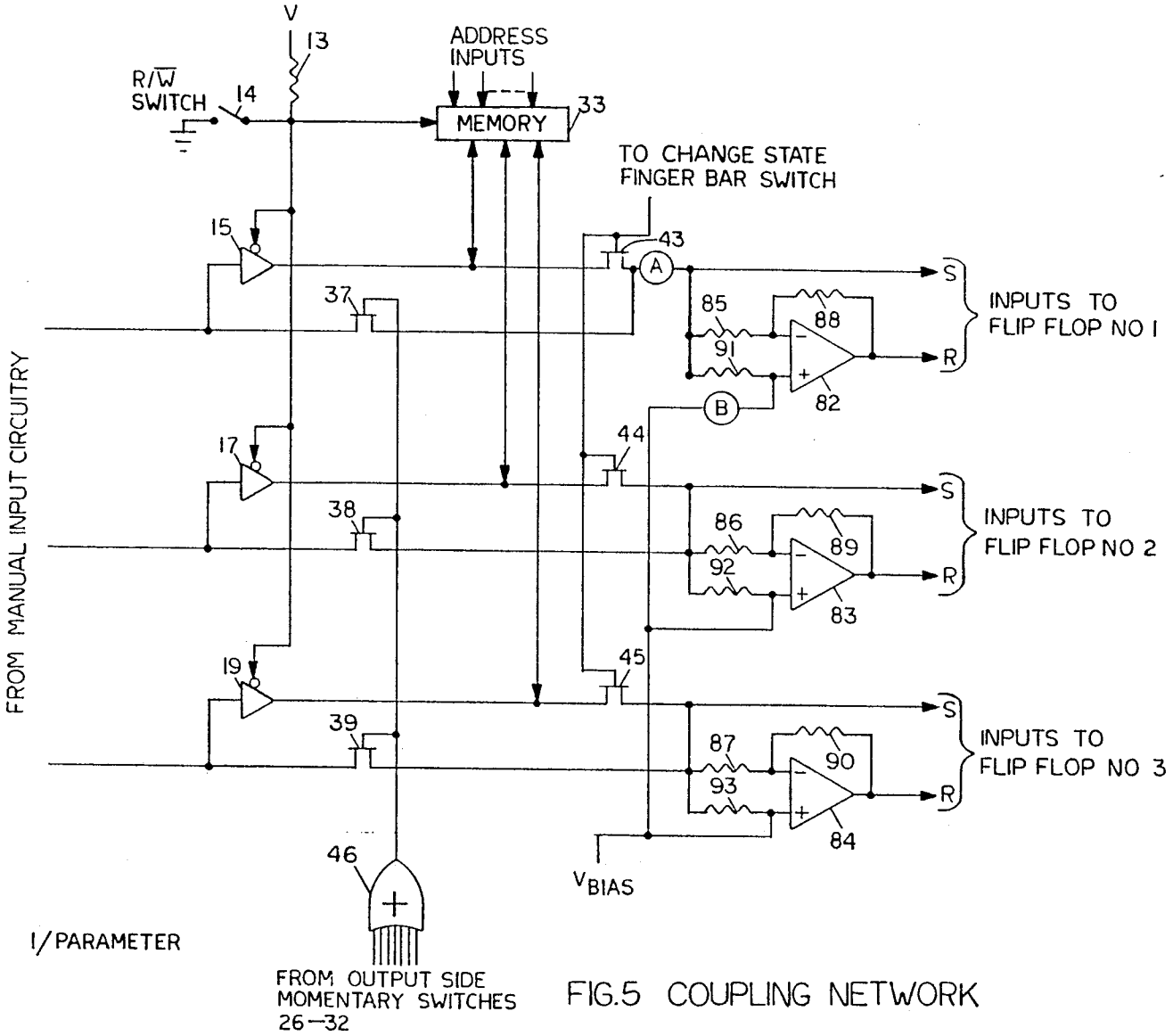
FIG. 5 and FIG. 6 are schematic and block diagrams of the coupling networks.

FIG. 5 displays the coupling network between the manual input circuitry, the memory that stores the parameter values, and the RS flip flops 48, 49, and 50 used for temporary memory. The coupling network must be compatible with the three modes of operation of the system. Thus, to write into the memory from the manual input circuitry, the switch 14 is closed to the negation potential, making the read/$\overline{\text{write}}$ input of the memory 33 a negation and putting the memory 33 into the write mode. In this mode the three state buffers 15, 17, and 19 are all active, and data specifying the value of the parameter stored at the point in memory 33 indicated by the address may be written into that memory from the manual input circuitry via these three state buffers 15, 17, and 19. During this period, the gates 43, 44, and 45 are nonconducting. The gates 37, 38, and 39 are made conducting by the OR gate 46 that is excited by whatever momentary switch 26 through 32 is closed. Thus, the new value of the corresponding parameter is applied to the set and reset terminals of the flip flops 48, 49, and 50. The signals are applied directly to the set inputs of the flip flops 48, 49, and 50, and, through biased inverters 82, 83, and 84, to the reset inputs of these flip flops 48, 49, and 50. The resistors in each of the pairs 85 and 88, 86 and 89, and 87 and 90 are about equal in value so that the gain of the inverters 82, 83, and 84 is about $-1$. Thus, an assertion on one of the lines from the manual input circuitry sets the corresponding RS flip flop; a negation of this line resets this flip flop. The inverters 82, 83, and 84 are biased to a potential that is halfway between the highest potential that is considered to be a negation for an input and the lowest potential that is considered to be an affirmation for an input (for TTL logic, this potential is 1.4 volts). Thus, when no switch is depressed, the inputs of the inverters 82, 83, and 84 and both the reset and set inputs of the flip flops will go to this intermediate potential, and the states of the RS flip flops 48, 49, and 50 will not change. (The state of an RS flip flop can be changed only when the appropriate input is at an affirmation potential suitable for that type of flip flop.) These bias potentials are effected by the resistors 85 through 93 and the potential bias.

The switch 14 is made nonconducting. The resistor 13, which is connected at its other end to an affirmation potential, pulls the read/$\overline{\text{write}}$ input of memory 33 upto this potential, thereby putting the memory 33 into the read mode and making the three state gates 15, 17, and 19 inactive, which means that their output impedance is high. Upon depression of the finger bar 2, the change-of-state contact 11 of the switch 16 becomes affirmative, causing the gates 43, 44, and 45 to become conducting and the address to increment by 1 step to the next combination stored in the memory. The binary representation of the parameter value is then applied to the set and reset inputs of the RS flip flops 48, 49, and 50 and changes their states to correspond to the output of the memory 33. The gates 43, 44, and 45 become nonconducting as soon as the finger bar 2 returns to its quiescent position because the switch 16 returns to contact 3, thus, permitting the resistor 10 to return the change-of-state line to a negation potential.

Nothing further happens to the RS flip flops 48, 49, and 50 in the quiescent state of the finger bar unless one of the momentary switches 26 through 32 is depressed. If and when such a switch is depressed, then the gates 37, 38, and 39 become conducting, because the output of the OR gate 46 becomes affirmative and the magnitude of the corresponding potential defined by this depressed switch is impressed on the RS flip flops 48, 49, and 50, as before. The states of these flip flops 48, 49, and 50 are changed correspondingly. No datom is written into the memory 33, however, because the read/$\overline{\text{write}}$ switch 14 is still nonconducting and the three state gates 15, 17, and 19 are inactive (nonconducting and with high output impedances).

Because the finger-bar motion can be quite rapid, the memory output may be overridden manually essentially instantly.

Figure 6:
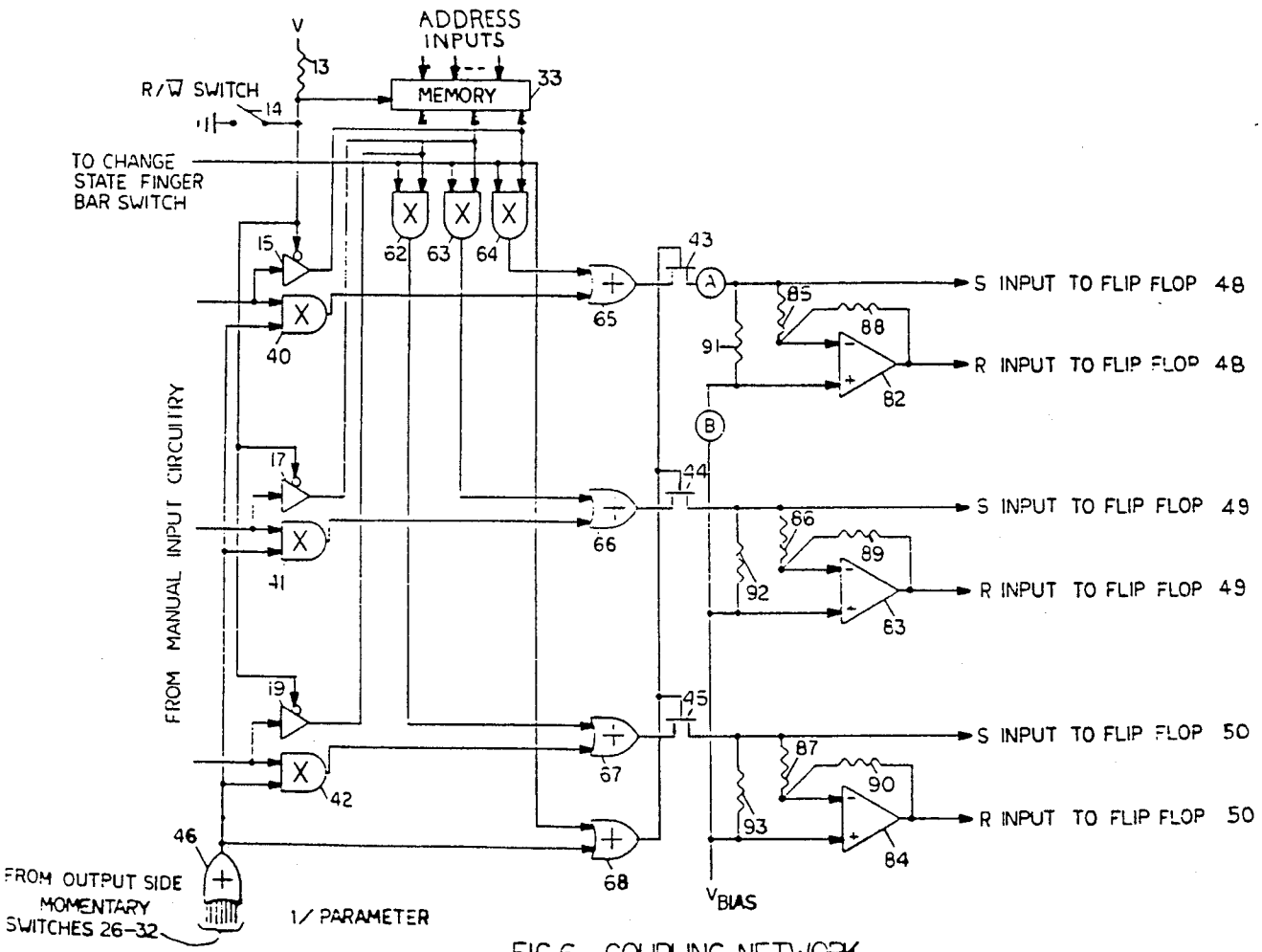

An alternative embodiment of the coupling network is shown in FIG. 6. Again, to write into the memory the read/$\overline{\text{write}}$ switch 14 is made conducting, thereby conditioning the memory 33 so that it can be written into and activating (making conducting) the gates 15, 17, and 19 so that a binary signal applied from the manual input circuitry is written into the memory 33. Further, during the time any momentary switch 26 through 32 is depressed, the OR gate 46 applies an affirmative signal to the AND gates 40, 41, and 42, thus permitting the signal from the depressed momentary switch 26 through 32 to be applied to the OR gates 65, 66, and 67. The output of these OR gates is conducted to the set and reset inputs of the flip flops 48, 49, and 50 by the gates 43, 44, and 45, which have been made conducting by the output of the OR gate 46. The binary signals are applied through operational-amplifier inverters 82, 83, and 84, as before, to the reset inputs of the flip flops 48, 49, and 50. The resistors in each of the pairs 85 and 88, 86 and 89, and 87 and 90 are about equal in value so that the gain of the inverters 82, 83, and 84 is about $-1$. These inverters 82, 83, and 84 are biased by the resistors 91, 92, and 93 connected between the input signal lines that go to the set inputs of the flip flops 48, 49, and 50, and a biasing potential that is half-way between the potential of the highest negation signal and the potential of the lowest affirmation signal, and by the resistors 85 through 90 connected between respective inverting inputs of the operational amplifiers 82, 83, and 84 and their outputs or the signal lines going to the set inputs of the flip flops 48, 49, and 50. Thus, when the gates 43, 44, and 45 are nonconducting, and the outputs of these gates are independent of the input, the R and S inputs of the flip flops 48, 49, and 50 move to this intermediate potential, leaving the state of the RS flip flops 48, 49, and 50 unchanged, since the state of these RS flip flops 48, 49, and 50 can be changed only when the appropriate input is moved to an affirmation potential suitable for that type of flip flop. Thus, the sound created can be heard during the period in which the player is adjusting it.

By making the read/$\overline{\text{write}}$ switch 14 nonconducting, the resistor 13, which is returned to an affirmative potential raises the potential of the read/$\overline{\text{write}}$ input of the memory 33 putting it into the read mode. Depression of the finger bar 2 against the urging of spring 1, causes the switch 16 to move to the change-of-state contact 11 causing this contact to be at an affirmation potential, which is otherwise urged to a negation potential by resistor 10, and making the AND gates 62, 63, and 64 conducting so that the output of the memory 33 is then applied to the respective OR gates 65, 66, and 67. The other inputs of these OR gates will be negations since at this moment no momentary switch 26 through 32 is depressed and the output of the OR gate 46 is a negation, thus making the AND gates 40, 41, and 42 nonconducting. The gates 43, 44, and 45 are made conducting by the change-of-state affirmation potential applied to the OR gate 68. Thus, the RS flip flops 48, 49, and 50 are brought to the respective states reflecting the binary output of the memory 33. Upon release of the finger bar 2, the tension spring 1 returns it to the quiescent position, the contact 11 goes to a negation potential with the urging of the resistor 10, which is connected at its other end to such a potential, the contact 3 goes to an affirmation potential to which the switch 16 is connected, the gates 62, 63, and 64 become nonconducting, the gates 43, 44, and 45 become nonconducting, and the inputs of the flip flops 48, 49, and 50 go to the half-way, do-nothing potential.

Subsequent depression of any momentary switch 26 through 32 will cause the AND gates 40, 41, and 42 to become conducting, as a result of the affirmation output of OR gate 46, the inputs of which are respectively connected to all the outputs of momentary switches 26 through 32. The potentials generated by the OR gates 34, 35, and 36, representing the magnitude of a parameter as a binary number, are applied through the AND gates 40, 41, and 42, and, through the OR gates 65, 66, and 67, to the set and reset inputs of the flip flops 48, 49, and 50. Thus may the output of the memory be overridden by depressing any of the momentary switches if the player should so desire.

Figure 7:
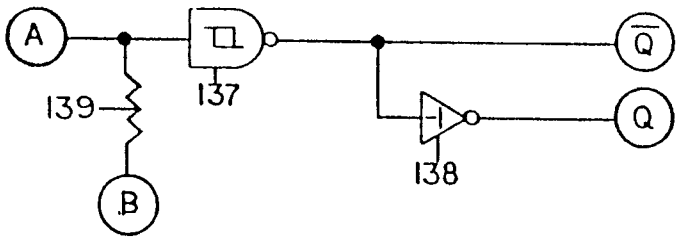
FIG. 7 and FIG. 8 are schematic diagrams of other, alternate output coupling circuits based on hysteresis circuits.
Figure 8:
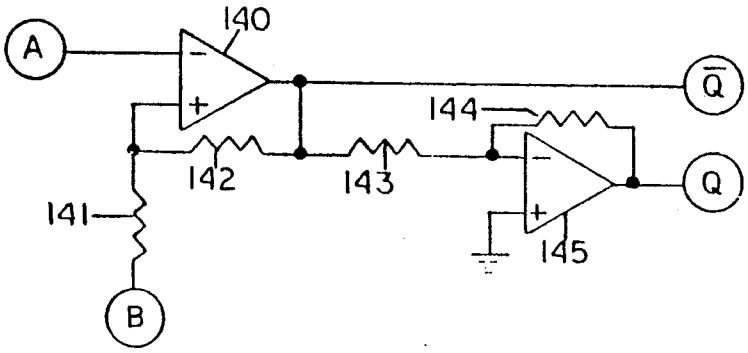

FIGS. 7 and 8 are two circuits alternate to the corresponding parts of those shown in FIGS. 5 and 6. Either may replace the circuits shown between circles in FIGS. 5 and 6. In substituting one circuit for another, each circled letter in FIG. 5 or 6 is replaced by the same circled letter in the replacement circuit. A point in a conductor is labeled by a circled letter, and the conductor is continuous through the circled letter.

FIG. 7 is based simply on a Schmitt trigger, 137, with a biasing potential applied through the resistor, 139, to the input of the Schmitt trigger. The biasing potential, $V_{bias}$, is midway between the positive-going and negative-going transition potentials of the Schmitt trigger. An inverter, 138, is tied to the output of the Schmitt trigger to provide the inverted signal, Q, needed for the binary code to 1-line decoding at the output, as shown in FIG. 3. If point A is made low at some instant by the input, then the output, $\overline{Q}$, is high, and the inverted output, Q, is low. If point A is made high at some instant by the input circuits, then the output, $\overline{Q}$, is low, and the inverted output, Q, is high. After isolation of the input by the gates, such as 37 and 43, the output potential is maintained, because the biasing potential $V_{bias}$, causes the input to move midway between the transition potentials of the Schmitt trigger.

FIG. 8 is simply a Schmitt trigger based on an operational amplifier, 140, with hysteresis. The biasing potential, $V_{bias}$, is applied through the resistor, 141; the hysteresis is provided by the positive feedback resistor, 142. Again, an inverter comprised of the operational amplifier, 145, and the input resistor, 143, and the negative feedback resistor, 144, between the output and inverting input, provides the complementary output to that provided by the comparator itself. If point A is made low at some instant by the input circuits, then the output, $\overline{Q}$, is high, and the inverted output, Q, is low. If point A is made high at some instant by the input circuits, then the output, $\overline{Q}$, is low, and the inverted output, Q, is high. After isolation of the input by the gates, such as 37 and 43, the output potentials are maintained, because the biasing potential, $V_{bias}$, causes the input to move midway between the transition potentials of the Schmitt trigger. This type of Schmitt trigger is well known, except for the biasing used here, and is discussed by R. T. Smather, T. M. Frederiksen, and W. M. Howard, A QUAD OF INDEPENDENTLY FUNCTIONING COMPARATORS in "Linear Applications", AN74, p. 74–2 ff (National Semiconductor, 1973).

Yet another choice consists in using tristate buffers in place of the electronic switches 37, 38, and 39 of FIG. 5 and 43, 44, and 45 of FIGS. 5 and 6 (all shown as field-effect transistors) to provide the isolation sought. These tristate buffers are discussed in Don Lancaster, TTL COOKBOOK, p. 139–140 (Howard W. Sams, 1979).

Isolation makes it possible to set up combinations, at the player's convenience and as time is available, during the playing of a composition and before use.

There has been described novel apparatus and techniques for preselecting changes in values of musical instrument controls that may be effected rapidly and with little effort on the player's part with reliable apparatus. It is evident that those skilled in the art may now make numerous uses and modifications of and departures from the specific embodiments described herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. Preselecting apparatus for a musical instrument comprising, manually actuable switching means for activating preselected combinations of parameters of said instrument, memory means for storing said preselected combinations, memory input circuit means responsive to said manually actuable switching means for providing a manually designated sequence of address signals identifying locations in said memory means for corresponding ones of said preselected combinations, manually operable circuit means for providing said preselected combinations, means for coupling said preselected combinations from said manually operable circuit means to said memory means in locations designated by said manually designated sequence of address signals, output coupling network means coupled to said memory means for providing a selected one of said combinations to said instrument to control the parameters of sound signals provided by said musical instrument in accordance with the preselected combination then provided by said memory means, sources of first and second potentials, said manually actuable switching means including a plurality of poles one of which comprises a change-of-state contact with each connected through a resistor to said source of second potential and having a common contact connected to said source of first potential.

2. Preselecting apparatus for a musical instrument in accordance with claim 1 and further comprising, circuit means responsive to actuation of said common contact engaging said change-of-state contact for providing an advance signal, and an address counter for providing an address signal to said memory input circuit means and responsive to said advance signal for providing a new address signal.

3. Preselecting apparatus for a musical instrument in accordance with claim 2 and further comprising, decoding means coupled to said address counter for providing a signal for displaying a visible indication of the address being interrogated in said memory means.

4. Preselecting apparatus for a musical instrument in accordance with claim 2 wherein said manually operable circuit means comprises, a plurality of switches for selectively connecting said source of first potential to a corresponding data line, a plurality of OR gates each having an output connected to an input of said address counter with each of said data lines connected to at most one individual input leg of each of said OR gates for providing a preset count signal to said address counter representative of a binary number designated by the positions of said switches.

5. Musical instrument preselecting apparatus comprising, manually actuable switching means for activating preselected combinations of parameters of said instrument, memory means for storing said preselected combinations, memory input circuit means responsive to said manually actuable switching means for providing an address signal identifying locations in said memory means, manually operable circuit means for providing said preselected combinations, means for coupling said preselected combinations from said manually operable circuit means to said memory means, output coupling network means coupled to said memory means for providing a selected one of said combinations to said instrument to control the parameters of sound signals provided by said musical instrument in accordance with the preselected combination then provided by said memory means, wherein said output coupling network comprises, a plurality of flip-flops for receiving signals from said memory means representative of parameters to be controlled, a plurality of visible indicators, and AND gate means coupled to said flip-flops for translating the binary signal represented by said flip-flops into a number signal for exciting one and only one of said visible indicators representative of the intensity of the parameter associated with the binary signal then represented by said flip-flops.

6. Musical instrument preselecting apparatus comprising, manually actuable switching means for activating preselected combinations of parameters of said instrument, memory means for storing said preselected combinations, memory input circuit means responsive to said manually actuable switching means for providing an address signal identifying locations in said memory means, manually operable circuit means for providing said preselected combinations, means for coupling said preselected combinations from said manually operable circuit means to said memory means, output coupling network means coupled to said memory means for providing a selected one of said combinations to said instrument to control the parameters of sound signals provided by said musical instrument in accordance with the preselected combination then provided by said memory means, wherein said output coupling network comprises, a plurality of flip-flops for receiving signals from said memory means representative of parameters to be controlled, wherein the means for coupling said memory means to said flip-flops include a direct connection to one of set and reset inputs of each flip-flop and means including an operational amplifier coupled between said memory means and the other of said set and reset inputs, and means for biasing each operational amplifier so that its output level connected to an associated reset input is at an intermediate do-nothing state when the operational amplifier input is biased to a do-nothing intermediate potential which is between first and second potentials.

7. Preselecting apparatus for a musical instrument in accordance with claim 6 wherein each operational amplifier includes resistors connected to both the inverting and noninverting inputs and between the inverting input and the output, the resistor between the inverting input and the output of the operational amplifier influencing the gain thereof, and a source of biasing potential connected directly to each noninverting input.

8. Preselecting apparatus for a musical instrument in accordance with claim 6 and further comprising, an electronic switch interconnecting respective ones of said operational amplifiers and said manually operable circuit means, at least one momentary switch, and means for closing the latter electronic switch in response to actuation of any momentary switch associated with said manually operable circuit means.

9. Preselecting apparatus for a musical instrument in accordance with claim 6 and further comprising, electronic switches for isolating respective inputs of said manually operable circuit means from the memory means output, said electronic switches being closed in response to actuation of said manually actuable switching means.

10. Preselecting apparatus for a musical instrument in accordance with claim 6 wherein the means for coupling said memory to said flip-flops comprises, a plurality of first AND gates each having one input leg coupled to an output of said memory means with the other input leg connected to a first potential if and only if said manually actuable switching means is actuated, a plurality of momentary switches, first OR gates and second AND gates, the output of each first AND gate being connected to one input leg of a respective first OR gate, the other input of said first OR gate being connected to the output of a respective second AND gate having one input leg connected to said manually operable input circuit means and the other input leg in common with a corresponding input leg of the other second AND gates and connected to the output of a second OR gate having respective input legs connected to respective momentary switches in said manually operable input circuitry, an electronic switch connecting the output of a respective first OR gate to one of the set or reset inputs of a respective flip-flop, a gating AND gate having its output connected to a gate electrode of each electronic switch and first and second input legs one of which is connected to the output of said second OR gate, the other of which is connected to said manually actuable switching means.

11. Preselecting apparatus for a musical instrument comprising, manually actuable switching means for activating preselected combinations of parameters of said instrument when performing a musical composition with said instrument, said manually actuable switching means including actuator bar switching means for actuation by the finger or toe of a performer operating said musical instrument and predetermined address select switching means for designating predetermined address signals associated with respective ones of said preselected combinations, digital memory means for storing each of said preselected combinations at a respective location designated by an associated address signal, memory input circuit means responsive to said manually actuable switching means for providing a manually designated sequence of address signals identifying locations in said digital memory means for corresponding ones of said preselected combinations, said memory input circuit means including presettable counting means responsive to said manually actuable switching means for incrementing in response to each actuation of said actuator bar switching means to provide a count signal for designating one location in said digital memory means of an associated preselected combination and responsive to said predetermined address select switching means for providing a count signal for designating one location in said digital memory means of an associated preselected combination corresponding to the address signal provided by said predetermined address select switching means, manually operable circuit means for providing said preselected combinations, means for coupling said preselected combinations from said manually operable circuit means to said digital memory means in respective locations designated by said manually designated sequence of address signals provided by said presettable counting means prior to performing said musical composition, output coupling network means coupled to said digital memory means for providing a selected one of said combinations to said instrument to control the parameters of sound signals provided by said musical instrument in accordance with the preselected combination then provided by said digital memory means while performing said musical composition in response to actuation of said manually actuable switching means until the next actuation of said manually actuable switching means at which time another of said preselected combinations is provided, said manually actuable switching means including means for independently manually designating each address in said sequence of manually designated address signals, wherein said output coupling network comprises, a plurality of flip-flops for receiving signals from said memory means representative of parameters to be controlled, electronic switches for isolating each said flip-flop from the memory means output, and means for closing said electronic switches in response to actuation of said manually actuable switching means.

12. Musical instrument preselecting apparatus comprising, manually actuable switching means for activating preselected combinations of parameters of said instrument, memory means for storing said preselected combinations, memory input circuit means responsive to said manually actuable switching means for providing an address signal identifying locations in said memory means, manually operable circuit means for providing said preselected combinations, means for coupling said preselected combinations from said manually operable circuit means to said memory means, output coupling network means coupled to said memory means for providing a selected one of said combinations to said instrument to control the parameters of sound signals provided by said musical instrument in accordance with the preselected combination then provided by said memory means, wherein said output coupling network comprises, a plurality of flip-flops for receiving signals from said memory means representative of parameters to be controlled, wherein the means for coupling said memory means to said flip-flops comprises, a plurality of first AND gates each having one input leg coupled to an output of said memory means with the other input leg connected to an affirmation potential if and only if said manually actuable switching means is actuated, a plurality of momentary switches, first OR gates and second AND gates, the output of each first AND gate being connected to one input leg of a respective first OR gate, the other input of said first OR gate being connected to the output of a respective second AND gate having one input leg connected to said manually operable input circuit means and the other input leg in common with a corresponding input leg of the other second AND gates and connected to the output of a second OR gate having respective input legs connected to respective momentary switches in said manually operable input circuitry, an electronic switch connecting the output of a respective first OR gate to one of the set or reset inputs of a respective flip-flop, a third OR gate having its output connected to a gate electrode of each electronic switch and first and second input legs one of which is connected to the output of said second OR gate, the other of which is connected to said manually actuable switching means.

13. Preselecting apparatus for a musical instrument in accordance with claim 12 and further comprising, a plurality of operational amplifiers each coupled to the output of a respective first OR gate, and means for biasing said operational amplifier so that its output assumes an intermediate do-nothing state when the input is biased to a do-nothing intermediate potential.

14. Preselecting apparatus for a musical instrument in accordance with claim 13 wherein each of said operational amplifiers is an operational amplifier with resistors connected to both inverting and noninverting inputs and the junction of the resistors coupled to the output of a respective first OR gate with a resistor connected between the inverting input and the output of said operational amplifier and the resistor connected between said inverting input and said junction influencing gain, and a source of biasing potential connected directly to the noninverting input.

15. Preselecting apparatus for a musical instrument comprising, manually actuable switching means for activating preselected combinations of parameters of said instrument, memory means for storing said preselected combinations, memory input circuit means responsive to said manually actuable switching means for providing a manually designated sequence of address signals identifying locations in said memory means for corresponding ones of said preselected combinations, manually operable circuit means for providing said preselected combinations, means for coupling said preselected combinations from said manually operable circuit means to said memory means in locations designated by said manually designated sequence of address signals, output coupling network means coupled to said memory means for providing a selected one of said combinations to said instrument to control the parameters of sound signals provided by said musical instrument in accordance with the preselected combination then provided by said memory means, sources of first and second potentials and wherein said manually operable circuit means comprises a plurality of single-pole, single-throw switches each having one terminal connected to said source of first potential, the other terminal of each being connected to said source of second potential through an individual resistor and to at least one input of a plurality of OR gates for providing to said OR gates a binary indication of the magnitude of the associated parameter, there being one and only one of said switches associated with each such magnitude provided.

16. Preselecting apparatus for a musical instrument comprising, manually actuable switching means for activating preselected combinations of parameters of said instrument when performing a musical composition with said instrument, said manually actuable switching means including actuator bar switching means for actuation by the finger or toe of a performer operating said musical instrument and predetermined address select switching means for designating predetermined address signals associated with respective ones of said preselected combinations, digital memory means for storing each of said preselected combinations at a respective location designated by an associated address signal, memory input circuit means responsive to said manually actuable switching means for providing a manually designated sequence of address signals identifying locations in said digital memory means for corresponding ones of said preselected combinations, said memory input circuit means including presettable counting means responsive to said manually actuable switching means for incrementing in response to each actuation of said actuator bar switching means to provide a count signal for designating one location in said digital memory means of an associated preselected combination and responsive to said predetermined address select switching means for providing a count signal for designating one location in said digital memory means of an associated preselected combination corresponding to the address signal provided by said predetermined address select switching means, manually operable circuit means for providing said preselected combinations, means for coupling said preselected combinations from said manually operable circuit means to said digital memory means in respective locations designated by said manually designated sequence of address signals provided by said presettable counting means prior to performing said musical composition, output coupling network means coupled to said digital memory means for providing a selected one of said combinations to said instrument to control the parameters of sound signals provided by said musical instrument in accordance with the preselected combination then provided by said digital memory means while performing said musical composition in response to actuation of said manually actuable switching means until the next actuation of said manually actuable switching means at which time another of said preselected combinations is provided, said manually actuable switching means including means for independently manually designating each address in said sequence of manually designated address signals, wherein said output coupling network comprises, a plurality of flip-flops for receiving signals from said memory means representative of parameters to be controlled, sources of first and second potentials, a potentiometer having first and second fixed terminals connected to said sources of first and second potentials respectively, analog-to-digital converting means for converting an input potential to a representative binary signal designated on its binary outputs, the wiper of said potentiometer being connected to the input of said analog-to-digital converting means, a respective AND gate for each of said binary outputs having first and second input legs with a first input leg connected to a respective binary output, the other input leg of each of the latter AND gates being connected together, a resistor connecting said connected-together input legs to the source of said second potential, and an A/D switch selectively connecting said connected-together input legs to said source of first potential, the output of each of the latter AND gates being coupled to respective inputs of flip-flops that store the magnitude of the binary signal provided by the latter AND gates.

17. Preselecting apparatus for a musical instrument comprising, manually actuable switching means for activating preselected combinations of parameters of said instrument, memory means for storing said preselected combinations, memory input circuit means responsive to said manually actuable switching means for providing a manually designated sequence of address signals identifying locations in said memory means for corresponding ones of said preselected combinations, manually operable circuit means for providing said preselected combinations, means for coupling said preselected combinations from said manually operable circuit means to said memory means in locations designated by said manually designated sequence of address signals, output coupling network means coupled to said memory means for providing a selected one of said combinations to said instrument to control the parameters of sound signals provided by said musical instrument in accordance with the preselected combination then provided by said memory means, said output coupling network comprising, a plurality of flip-flops for receiving signals from said memory means representative of parameters to be controlled, a source of first and second potentials, a potentiometer having first and second fixed terminals connected to said sources of first and second potentials respectively, analog-to-digital converting means for converting an input potential to a representative binary signal designated on its binary outputs, the wiper of said potentiometer being connected to the input of said analog-to-digital converting means, a respective AND gate for each of said binary outputs having first and second input legs with a first input leg connected to a respective binary output, the other input leg of each of the latter AND gates being connected together, a resistor connecting said connected-together input legs to the source of said second potential, an A/D switch selectively connecting said connected-together input legs to said source of first potential, the output of each of the latter AND gates being coupled to respective inputs of flip-flops that store the magnitude of the binary signal provided by the latter AND gates, at least one momentary switch and a corresponding plurality of OR gates for combining the outputs of the latter AND gates with the potentials provided by said momentary switches.

18. Musical instrument preselecting apparatus comprising, manually actuable switching means for activating preselected combinations of parameters of said instrument, memory means for storing said preselected combinations, memory input circuit means responsive to said manually actuable switching means for providing an address signal identifying locations in said memory means, manually operable circuit means for providing said preselected combinations, means for coupling said preselected combinations from said manually operable circuit means to said memory means, output coupling network means coupled to said memory means for providing a selected one of said combinations to said instrument to control the parameters of sound signals provided by said musical instrument in accordance with the preselected combination then provided by said memory means, a plurality of three-state buffers the input of each of which is connected to one and only one output line of said manually operable circuit means and the output of which is connected to a respective input of said memory means for delivering data for storage into said memory means, and read-write switching means for selectively providing a write potential to said memory means and to said three-state buffers for establishing a low output impedance mode for said three-state buffers to provide a low impedance connection between an associated manually operable circuit means output line and said memory means through each three-state buffer.

19. Musical instrument preselecting apparatus comprising, manually actuable switching means for activating preselected combinations of parameters of said instrument, memory means for storing said preselected combinations, memory input circuit means responsive to said manually actuable switching means for providing an address signal identifying locations in said memory means, manually operable circuit means for providing said preselected combinations, means for coupling said preselected combinations from said manually operable circuit means to said memory means, output coupling network means coupled to said memory means for providing a selected one of said combinations to said instrument to control the parameters of sound signals provided by said musical instrument in accordance with the preselected combination then provided by said memory means, sources of first and second potentials, said manually actuable switching means including a plurality of poles each connected through a resistor to said source of second potential and having a common contact connected to said source of first potential, circuit means responsive to actuation of said common contact engaging said change-of-state contact for providing an advance signal, an address counter for providing an address signal to said memory input circuit means and responsive to said advance signal for providing a new address signal, decoding means coupled to said address counter for providing a signal for displaying a visible indication of the address being interrogated in said memory means, wherein said manually operable circuit means comprises, a plurality of switches for selectively connecting said source of first potential to a corresponding data line, a plurality of OR gates each having an output connected to an input of said address counter with each of said data lines connected to at most one individual input leg of each of said OR gates for providing a preset count signal to said address counter representative of a binary number designated by the positions of said switches.

20. Musical instrument preselecting apparatus comprising, manually actuable switching means for activating preselected combinations of parameters of said instrument while performing a musical composition, said manually actuable switching means including actuator bar switching means for actuation by the finger or toe of a performer operating said musical instrument and predetermined address select switching means for designating predetermined address signals associated with respective ones of said preselected combinations, digital memory means for storing said preselected combinations at a respective locations designated by an associated address signal, memory input circuit means responsive to said manually actuable switching means for providing a manually designated sequence of address signals identifying locations in said memory means for corresponding ones of said preselected combinations, said memory input circuit means including presettable counting means responsive to said manually actuable switching means for incrementing in response to each actuation of said actuator bar switching means to provide a count signal for designating one location in said digital memory means of an associated preselected combination and responsive to said predetermined address select switching means for providing a count signal for designating one location in said digital memory means of an associated preselected combination corresponding to the address signal provided by said predetermined address select switching means, manually operable circuit means for providing said preselected combinations, means for coupling said preselected combinations from said manually operable circuit means to said digital memory means in respective locations designated by said manually designated sequence of address signals provided by said presettable counting means prior to performing said musical composition, output coupling network means coupled to said digital memory means for providing a selected one of said combinations to said instrument to control the parameters of sound signals provided by said musical instrument in accordance with the preselected combination then provided by said digital memory means while performing said musical composition in response to actuation of said manually actuable switching means until the next actuation of said manually actuable switching means at which time another of said preselected combinations is provided, said digital memory means for storing said preselected combinations including means defining memory locations randomly accessible for both storing said preselected combinations and for recovering the stored preselected combinations in a sequence different from that in which they were stored.

21. Musical instrument preselecting apparatus comprising, manually actuable switching means for activating preselected combinations of parameters of said instrument when performing a musical composition with said instrument, said manually actuable switching means including actuator bar switching means for actuation by the finger or toe of a performer operating said musical instrument and predetermined address select switching means for designating predetermined address signals associated with respective ones of said preselected combinations, digital memory means for storing each of said preselected combinations at a respective locations designated by an associated address signal, memory input circuit means responsive to said manually actuable switching means for providing a manually designated sequence of address signals identifying locations in said digital memory means for corresponding ones of said preselected combinations, said memory input circuit means including presettable counting means responsive to said manually actuable switching means for incrementing in response to each actuation of said actuator bar switching means to provide a count signal for designating one locations in said digital memory means of an associated preselected combination and responsive to said predetermined address select switching means for providing a count signal for designating one location in said digital memory means of an associated preselected combination corresponding to the address signal provided by said predetermined address select switching means, manually operable circuit means for providing said preselected combinations, means for coupling said preselected combinations from said manually operable circuit means to said digital memory means in respective locations designated by said manually designated sequence of address signals provided by said presettable counting means prior to performing said musical composition, and output coupling network means coupled to said digital memory means for providing a selected one of said combinations to said instrument to control the parameters of sound signals provided by said musical instrument in accordance with the preselected combination then provided by said digital memory means while performing said musical composition in response to actuation of said manually actuable switching means until the next actuation of said manually actuable switching means at which time another of said preselected combinations is provided, said manually actuable switching means including means for independently manually designating each address in said sequence of manually designated address signals, wherein said digital memory means for storing said preselected combinations includes means defining memory locations randomly accessible for both storing said preselected combinations and for recovering the stored preselected combinations in a sequence different from that in which they were stored.

22. Musical instrument preselecting apparatus comprising, manually actuable switching means for activating preselected combinations of parameters of said instrument when performing a musical composition with said instrument, said manually actuable switching means including actuator bar switching means for actuation by the finger or toe of a performer operating said musical instrument and predetermined address select switching means for designating predetermined address signals associated with respective ones of said preselected combinations, digital memory means for storing each of said preselected combinations at a respective locations designated by an associated address signal, memory input circuit means responsive to said manually actuable switching means for providing a manually designated sequence of address signals identifying locations in said digital memory means for corresponding ones of said preselected combinations, said memory input circuit means including presettable counting means responsive to said manually actuable switching means for incrementing in response to each actuation of said actuator bar switching means to provide a count signal for designating one location in said digital memory means of an associated preselected combination and responsive to said predetermined address select switching means for providing a count signal for designating one location in said digital memory means of an associated preselected combination corresponding to the address signal provided by said predetermined address select switching means, manually operable circuit means for providing said preselected combinations, means for coupling said preselected combinations from said manually operable circuit means to said digital memory means in respective locations designated by said manually designated sequence of address signals provided by said presettable counting means prior to performing said musical composition, and output coupling network means coupled to said digital memory means for providing a selected one of said combinations to said instrument to control the parameters of sound signals provided by said musical instrument in accordance with the preselected combination then provided by said digital memory means while performing said musical composition in response to actuation of said manually actuable switching means until the next actuation of said manually actuable switching means at which time another of said preselected combinations is provided, said manually actuable switching means including means for independently manually designating each address in said sequence of manually designated address signals, wherein said output coupling network means comprises a hysteresis-based output circuit.

23. Musical instrument preselecting apparatus in accordance with claim 22 wherein said hysteresis-based output circuit comprises, a Schmitt trigger, a source of a biasing potential coupled to the input of said Schmitt trigger, first and second output terminals, an inverter, the output of said Schmitt trigger being directly coupled to said first output terminal, said inverter coupling the output of said Schmitt trigger to said second output terminal.

24. Musical instrument preselecting apparatus in accordance with claim 23 wherein said Schmitt trigger comprises an operational amplifier characterized by hysteresis, a positive feedback resistor intercoupling the output of said first operational amplifier and one input thereof to establish said hysteresis, said inverter comprising a second operational amplifier having a negative feedback resistor intercoupling the output of said operational amplifier to an input thereof.

25. Musical instrument preselecting apparatus comprising, manually actuable switching means for activating preselected combinations of parameters of said instrument when performing a musical composition with said instrument, said manually actuable switching means including actuator bar switching means for actuation by the finger or toe of a performer operating said musical instrument and predetermined adress select switching means for designating predetermined address signals associated with respective ones of said preselected combinations, digital memory means for storing each of said preselected combinations at a respective location designated by an associated address signal, memory input circuit means responsive to said manually actuable switching means for providing a manually designated sequence of address signals identifying locations in said digital memory means for corresponding ones of said preselected combinations, said memory input circuit means including presettable counting means responsive to said manually actuable switching means for incrementing in response to each actuation of said actuator bar switching means to provide a count signal for designating one locations in said digital memory means of an associated preselected combination and responsive to said predetermined address select switching means for providing a count signal for designating one location in said digital memory means of an associated preselected combination corresponding to the address signal provided by said predetermined address select switching means, manually operable circuit means for providing said preselected combinations, means for coupling said preselected combinations from said manually operable circuit means to said digital memory means in respective locations designated by said manually designated sequence of address signals provided by said presettable counting means prior to performing said musical composition, and output coupling network means coupled to said digital memory means for providing a selected one of said combinations to said instrument to control the parameters of sound signals provided by said musical instrument in accordance with the preselected combination then provided by said digital memory means while performing said musical composition in response to actuation of said manually actuable switching means until the next actuation of said manually actuable switching means at which time another of said preselected combinations is provided, said manually actuable switching means including means for independently manually designating each address in said sequence of manually designated address signals.

26. Preselecting apparatus for a musical instrument in accordance with claim 25 wherein said output coupling network comprises, a plurality of flip-flops for receiving signals from said memory means representative of parameters to be controlled.

* * * * *